United States Patent [19]

Sakurai

[11] 3,958,508

[45] May 25, 1976

[54] DEVICE FOR POSITIONING AN OBJECT TO BE PRINTED IN A PRINTING MACHINE

[75] Inventor: Yoshikuni Sakurai, Tokyo, Japan

[73] Assignee: Sakurai Seisakusho, Ltd., Mino, Japan

[22] Filed: Dec. 18, 1974

[21] Appl. No.: 533,939

[30] Foreign Application Priority Data

Aug. 22, 1974 Japan ..... 49-95561

[52] U.S. Cl. ..... 101/407 BP; 101/415.1

[51] Int. Cl.[2] ..... B41F 1/36

[58] Field of Search ..... 101/115, 121, 122, 123, 101/126, 415.1, 407 R, 407 BP, 383, 384

[56] References Cited

UNITED STATES PATENTS

| | | | |
|---|---|---|---|
| 2,596,864 | 5/1952 | Penker | 101/269 |
| 2,942,544 | 6/1960 | Williams | 101/269 |
| 3,151,553 | 10/1964 | Norton | 101/415.1 |
| 3,160,096 | 12/1964 | Norton | 101/401.1 |
| 3,357,350 | 12/1967 | Jaffa et al. | 101/123 |
| 3,456,587 | 7/1969 | Hulen | 101/415.1 |
| 3,536,004 | 10/1970 | Derrickson | 101/407 R |
| 3,812,779 | 5/1974 | Cobb | 101/115 |

*Primary Examiner*—J. Reed Fisher
*Attorney, Agent, or Firm*—Willis Bugbee

[57] ABSTRACT

This device for positioning an object to be printed in a printing machine is adapted to guide projected printing pins into holes formed in the object to be printed during printing and to prevent said object from lifting off of the surface plate while said positioning pins are being inserted into said holes.

1 Claim, 2 Drawing Figures

DEVICE FOR POSITIONING AN OBJECT TO BE PRINTED IN A PRINTING MACHINE

SUMMARY OF THE INVENTION

The present invention provides a device which accurately positions an object to be printed in a printing machine having mechanism which is adapted to precisely project locating pins upward into holes previously formed in the object to be printed and at the same time temporarily clamps the object to the surface plate so as to prevent said object from lifting off of the surface plate while said positioning pins are being inserted into said holes.

BACKGROUND OF THE INVENTION

Hitherto, in screen printing machines, when print board or an object of rigid thick material has been printed, it has been difficult to accurately position such an object to be printed and particularly to engage positioning pins in previously-formed holes in said object since the object is lifted by said positioning pins.

In order that the present invention may be more clearly understood, reference will now be made, by way of example, to the accompanying drawings in which.

Figure 1:
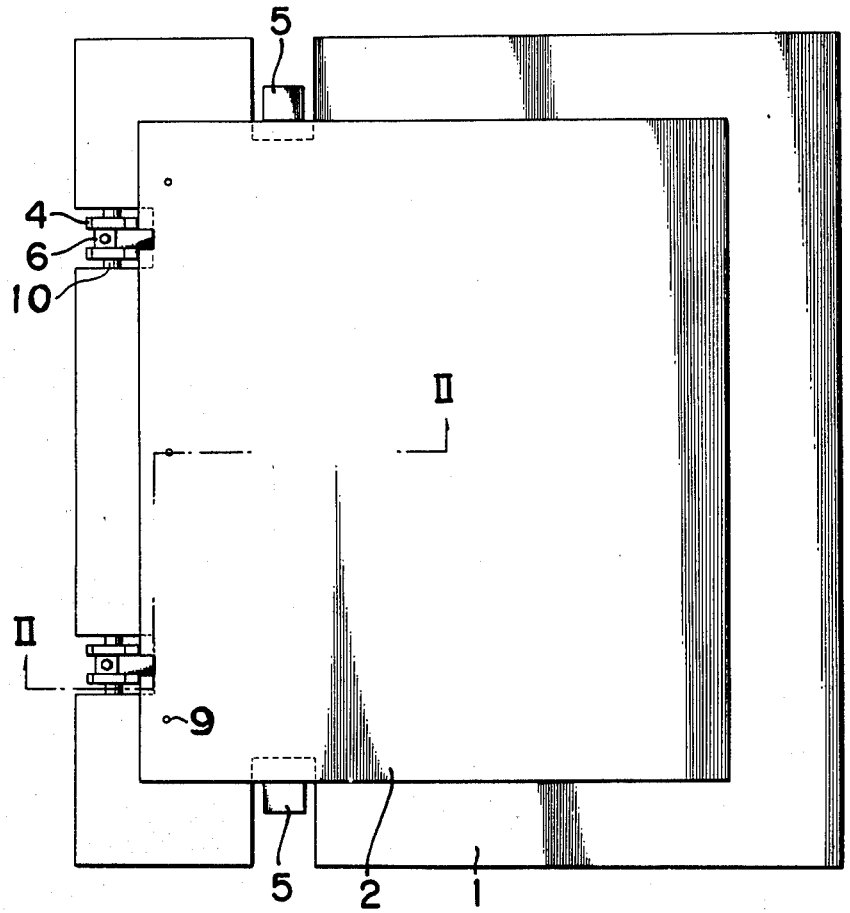
FIG. 1 is a top plan view of a device embodying the present invention.

Referring to the drawings showing a preferred embodiment of the positioning device according to the invention, a surface plate 1 supports an object 2 to be printed which has been fed onto the surface plate 1 by means of a vacuum sucking disk. The surface plate 1 is provided with vertically-reciprocable positioning pins 3 and is also provided with front positioning members 4 and right and left side positioning members 5 for temporarily positioning the object to be printed in the longitudinal direction and the transverse direction, respectively. Each of the front positioning members 4 is provided with a clamping member 6 which is rotated at a proper time to an operative position at which the clamping member clamps the object to be printed in the printing position. The vertically-reciprocable positioning pins 3 are actuated in timed relationship with the clamping members 6 and front positioning members 4 by means of a bell crank lever 7 pivotally supported at 8.

Figure 2:
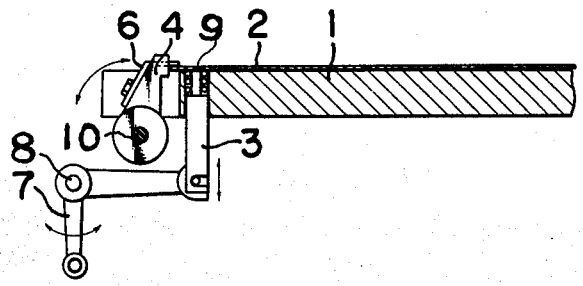
FIG. 2 is a sectional view taken along the line II—II of FIG. 1.

In the operation of the invention, the object to be printed, which has previously been provided with locating holes 9, is fed by means of a conventional feeder (not shown), so that it is placed on the surface plate 1. The front positioning pads 4 are swung upward into their raised positions shown in FIGS. 1 and 2 as their shaft 10 is rotated. Meanwhile, the side positioning members 5 are actuated to push the object 2 laterally to its normal printing position so as to correct its position.

As a result, the temporary positioning of the object is effected. At the same time, the clamp member 6 is closed by the rotation of the shaft 10 so as to hold down the object 2 on the surface plate 1 and thereby to prevent the object from lifting out of its normal printing position on the surface plate 1. The positioning pins 3 connected to the bell crank lever 7 are then actuated to fit into the locating holes 9 which have previously been punched in the object 2 to be printed, whereby to effect the positioning of the object 2 in both the longitudinal direction and the transverse direction. The positioning pins 3 are temporarily maintained in the holes 9 in the object 2 to be printed in order to prevent an undesired displacement of the object 2 during the printing process while the front positioning members 4 and the side positioning members 5 are returned to their original positions, and are kept in their retracted original positions until the next object to be printed is fed onto the surface plate 1. The above mentioned operations are then repeated.

Many variations may be effected without departing from the spirit of the present invention. It is to be understood that the present invention comprehends these, together with other variations in details within the scope of the appended claim.

What is claimed is:

1. A device for positioning an object containing prepunched locating holes and intended to be printed in a printing machine, said device comprising a surface plate on which said object is placed, front and side positioning members movable simultaneously longitudinally and transversely respectively of said surface plate for temporarily positioning said object on said surface plate in the longitudinal and the transverse directions, positioning pins adapted to engage the prepunched locating holes in said object positioned on said surface plate, and a clamping member provided on said front positioning member and movable into clamping engagement with said object substantially simultaneously with said front and side positioning members, said positioning pins being adapted to fit into the locating holes in said object during printing and movable into said locating holes in timed relationship with and immediately subsequent to the longitudinal and transverse positioning movements respectively of said front and side positioning members and the clamping movement of said clamping member and said clamping member being adapted to prevent said object from lifting off of its final position on said surface plate while said positioning pins are inserted in the locating holes.

* * * * *